US006740011B1

(12) United States Patent
Tsai et al.

(10) Patent No.: US 6,740,011 B1
(45) Date of Patent: May 25, 2004

(54) DEVICE FOR EXERCISING FOOT MUSCLE

(76) Inventors: Cheng-Chung Tsai, No. 123, Ho-Ping Rd., Liu-Pao Village, Ta-Ya Hsiang, Taichung Hsien (TW); Cheng-Li Tsai, No. 350, Sec. 4, Chung-Ching Rd., Liu-Pao Village, Ta-Ya Hsiang, Taichung Hsien (TW)

( * ) Notice: Subject to any disclaimer, the term of this patent is extended or adjusted under 35 U.S.C. 154(b) by 50 days.

(21) Appl. No.: 10/241,042

(22) Filed: Sep. 12, 2002

(51) Int. Cl.[7] ..... A63B 23/04

(52) U.S. Cl. ..... 482/80; 482/81; 482/146; 482/147

(58) Field of Search ..... 482/79, 80, 146–147, 482/51, 74, 132, 83–90, 70, 71, 136–139, 148, 126, 123; 601/28–33, 134, 23

(56) References Cited

U.S. PATENT DOCUMENTS 2,206,902 A * 7/1940 Kost ..... 482/146
2,772,881 A * 12/1956 Funclom ..... 482/71
3,782,721 A * 1/1974 Passara ..... 482/146
3,791,645 A * 2/1974 Stelma ..... 482/71
4,376,532 A * 3/1983 Hunstad ..... 482/71
5,879,275 A * 3/1999 Aruin ..... 482/146

* cited by examiner

*Primary Examiner*—Jerome W. Donnelly
(74) *Attorney, Agent, or Firm*—Harrison & Egbert

(57) ABSTRACT

A device is designed to exercise foot muscle and is formed of a base on which two rotary mounts are disposed. The rotary mounts are provided with two upright fastening plates, each having a fastening hole. Two footrests are provided in the underside with two pivoting plates, each having a pivoting hole. The footrests are pivotally fastened to the rotary mounts such that the pivoting plates and the fastening plates are pivoted together by two pivots which are disposed in the pivoting hole and the fastening hole. The footrests turn horizontally along with the rotary mounts and turn up and down on the pivots.

1 Claim, 4 Drawing Sheets

DEVICE FOR EXERCISING FOOT MUSCLE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an exercise device, and more particularly to a device for turning feet of a person in one direction and then another so as to exercise the muscles of the feet.

BACKGROUND OF THE INVENTION

The conventional foot exercising device comprises a base, and two footrests which are mounted on the base in conjunction with the ball bearings such that the footrests can be turned left and then right, or vice versa, for the purpose of training the muscles of the feet resting on the two footrests of the device. The footrests of the conventional foot exercising device are capable of turning only in a horizontal plane. In another words, the conventional foot exercising device is limited in design in that it is not provided with means to enable the feet of a person to engage in a vertical exercise.

BRIEF SUMMARY OF THE INVENTION

The primary objective of the present invention is to provide a foot exercising device which is designed to enable a user to engage in a horizontal foot exercise as well as a vertical foot exercise.

In keeping with the principle of the present invention, the foregoing objective of the present invention is attained by the foot exercising device comprising a base on which two rotary mounts are disposed. The two rotary mounts are provided thereon with a footrest serving as a support to rest the foot of a user of the device thereon. The two footrests can be turned one way and then another in a horizontal plane, thanks to the two rotary mounts on which the two footrests are disposed. The footrests are provided in the underside with two pivoting plates, each having a pivoting hole. The rotary mounts are provided in the upper side with two upright fastening plates, each having a fastening hole. The footrests are pivotally mounted on the rotary mount such that the pivoting plates of each footrest are pivotally fastened with the fastening plates of the rotary mount by a pivot which is received in the pivoting hole of the pivoting plate and the fastening hole of the fastening plate. The footrests can be thus used like a seesaw so that when the toe end of the footrest goes up, the heel end of the footrest comes down.

The features and the advantages of the present invention will be more readily understood upon a thoughtful deliberation of the following detailed description of the present invention with reference to the accompanying drawings.

DETAILED DESCRIPTION OF THE INVENTION

Figure 1:
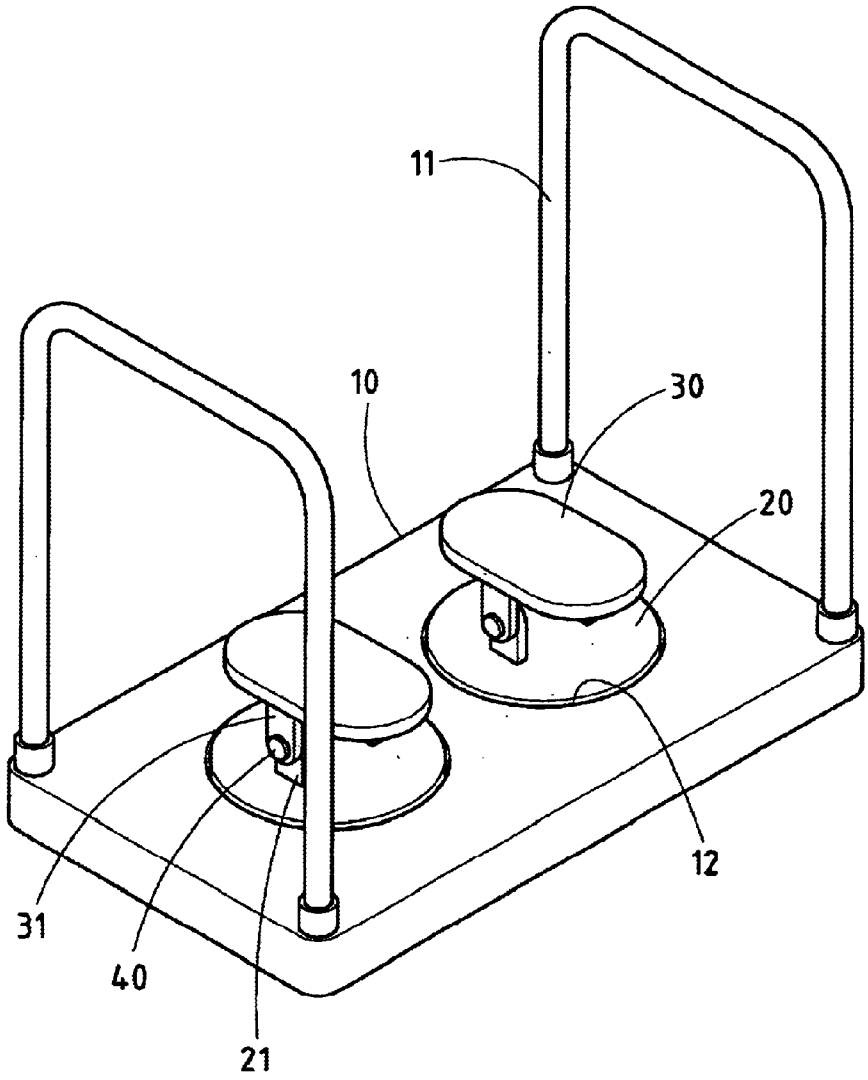
FIG. 1 shows a perspective view of the present invention.
Figure 2:
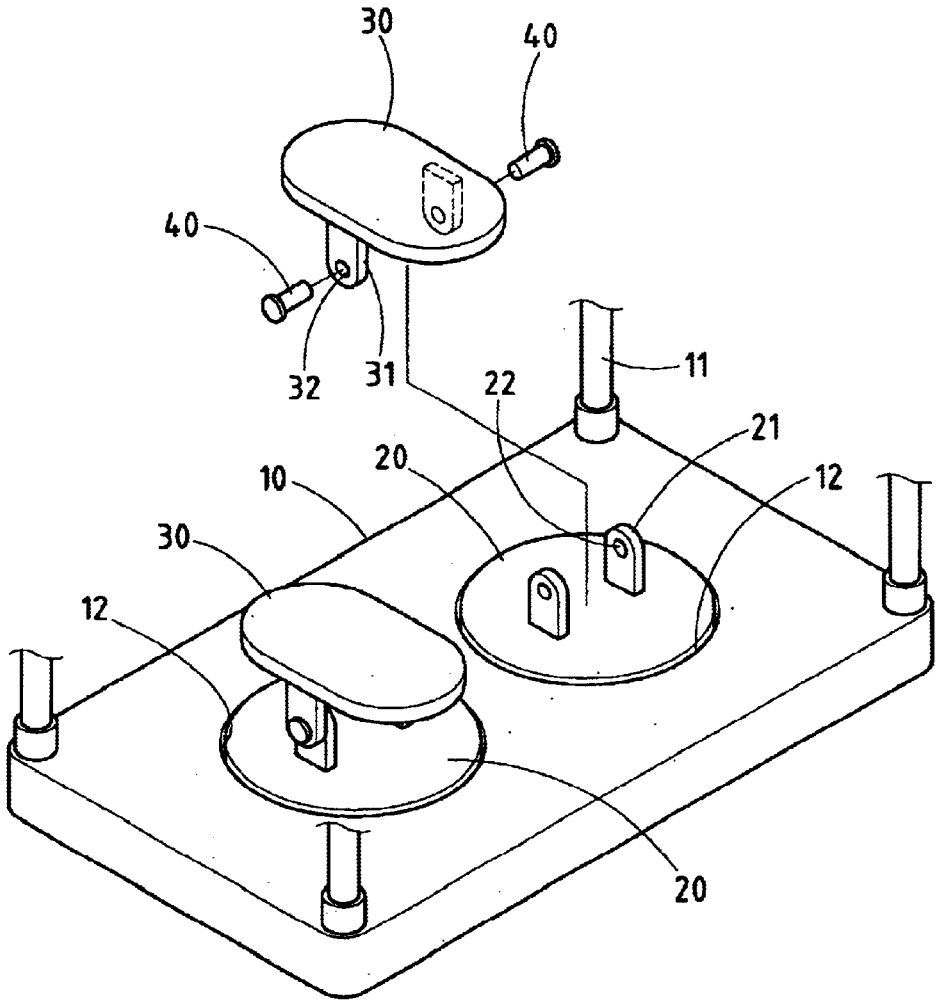
FIG. 2 shows a partial exploded view of the present invention.

As shown in FIGS. 1 and 2, a device of the present invention is designed to train the muscles of a person's feet and is formed of a base 10, two rotary mounts 20, and two footrests 30.

The base 10 is rested on a surface and provided with two hand rails 11 which are fastened uprightly on the upper side of two longitudinal ends of the base 10. The base 10 is provided in the upper side with two round aperture (herein after referred to as: round slots 12 which are separated from each other by a redetermined distance.

The two rotary mounts 20 are corresponding in form and size to the round slots 12 of the base 10. The two rotary mounts 20 are respectively pivoted in the round slots 12 such that the rotary mounts 20 can be caused by an external force to make a turn of 360 degrees in the round slots 12.

Figure 3:
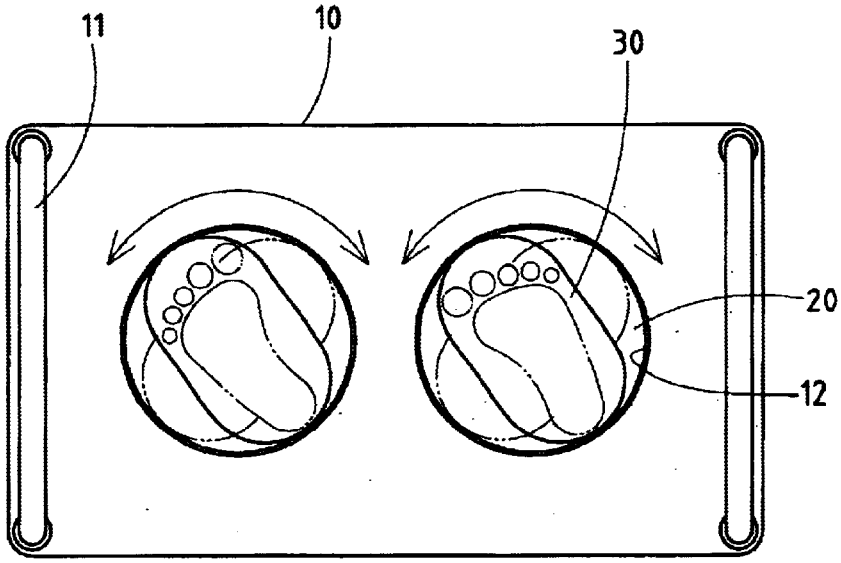
FIG. 3 shows a top plan view of the present invention in action.

The two footrests 30 are respectively mounted on the rotary mounts 20 such that the footrests 30 turn along with the rotary mounts 20 in a horizontal plane, as illustrated in FIG. 3. The feet of a user of the device of the present invention are turned left and then right, or vice versa, by the footrests 30.

Figure 4:
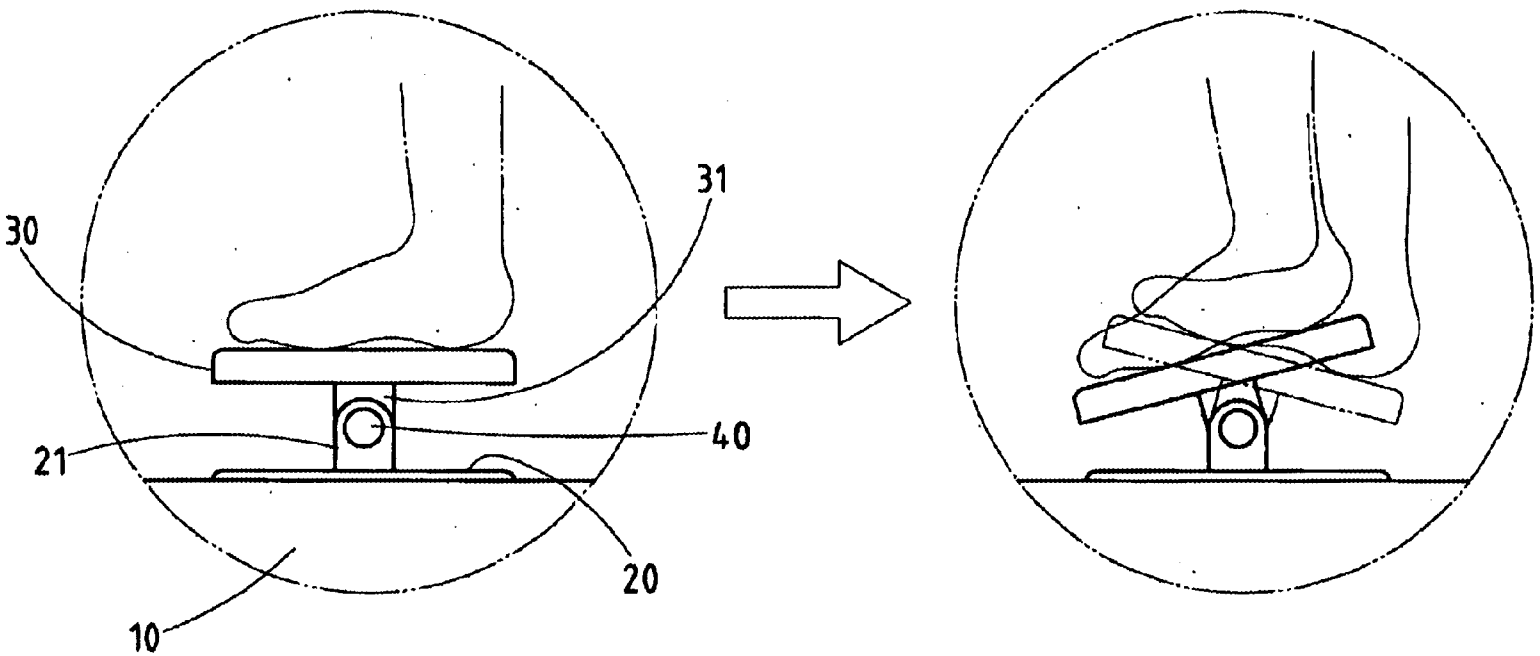
FIG. 4 shows a side plan view of the present invention at work.

The device of the present invention is characterized by the two rotary mounts 20 and the two footrests 30. The two rotary mounts 20 are provided in the upper side with two upright fastening plates 21 which are separated from each other by a predetermined distance and are provided with a fastening hole 22, as shown in FIG. 2. The two footrests 30 are provided in the midsegment of the underside thereof with two pivoting plates 31 which are provided with a pivoting hole 32. The footrests 30 are respectively mounted on the rotary mounts 20 such that the two pivoting plates 31 of the footrests 30 and the two fastening plates 21 of the rotary mounts 20 are pivoted together by two pivots 40 which are disposed in the pivoting hole 32 and the fastening hole 22. In another words, each footrest 30 is balanced on the pivot 40 so that when a toe end of the footrest 30 goes up, a heel end of the footrest 30 comes down, as illustrated in FIG. 4.

In light of the footrests 30 of the device of the present invention being provided with means to make a horizontal movement and an up-and-down movement, the device of the present invention is relatively versatile as compared with the conventional counterpart.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following appended claim.

We claim:

1. A device for exercising foot muscle, said device comprising:

a base provided in an upper side with two hand rails, round apertures arranged at an interval;

two rotary mounts each rotary mount respectively pivotally mounted in said round apertures of said base such that said rotary mounts turn horizontally in said round apertures of said base; reciprocating movement of said rotary mounts along said base;

two footrests fastened respectively on said rotary mounts such that said footrests turn horizontally along with said rotary mounts, and that said footrests serve as a support to rest thereon the foot of a user of said device;

wherein said rotary mounts are provided in an upper side with two fastening plates extending uprightly therefrom, with each of said two fastening plates being provided with a fastening hole;

wherein said footrests are provided in an underside with two pivoting plates extending therefrom, with each of said two pivoting plates being provided with a pivoting hole whereby each of said footrests is fastened with one of said rotary mounts such that said two pivoting plates of said footrest and said two fastening plates of said rotary mount are pivoted together by two pivots which are disposed respectively in said pivoting hole and said fastening hole, thereby enabling two longitudinal ends of each of said two footrests to turn up and down on said pivot.

* * * * *